United States Patent [19]

Juris et al.

[11] Patent Number: 4,498,719

[45] Date of Patent: Feb. 12, 1985

[54] ENVIRONMENTAL CONNECTOR ASSEMBLY

[75] Inventors: Mitchell A. Juris, Chicago; David A. Gallagher, Romeoville, both of Ill.

[73] Assignee: Allied Corporation, Morristown, N.J.

[21] Appl. No.: 445,403

[22] Filed: Nov. 30, 1982

Related U.S. Application Data

[63] Continuation of Ser. No. 236,369, Feb. 20, 1981, abandoned, which is a continuation of Ser. No. 864,975, Dec. 27, 1977, abandoned.

[51] Int. Cl.[3] ..... H01R 13/52; H01R 13/627

[52] U.S. Cl. ..... 339/60 R; 339/91 R

[58] Field of Search ..... 339/60 R, 60 M, 61 R, 339/61 M, 91 R, 66 R, 66 M

[56] References Cited

U.S. PATENT DOCUMENTS

| | | | |
|---|---|---|---|
| 3,199,060 | 8/1965 | Marasco | 339/60 R |
| 3,445,804 | 5/1969 | Perkins | 339/62 |
| 3,611,255 | 10/1971 | Shroyer | 339/60 R |
| 3,659,250 | 4/1972 | Horton | 339/91 B |
| 3,676,833 | 7/1972 | Johnson | 339/49 R |
| 3,874,761 | 4/1975 | Stauffer | 339/60 R |
| 3,930,705 | 1/1976 | Gallagher | 339/59 M |
| 3,960,429 | 6/1976 | Moulin | 339/91 R |

FOREIGN PATENT DOCUMENTS

| | | |
|---|---|---|
| 681668 | 7/1966 | Belgium . |
| 1440918 | 12/1968 | Fed. Rep. of Germany . |
| 1804945 | 11/1969 | Fed. Rep. of Germany . |
| 1011629 | 4/1952 | France . |
| 938296 | 10/1963 | United Kingdom . |

*Primary Examiner*—Neil Abrams

*Attorney, Agent, or Firm*—C. D. Lacina

[57] ABSTRACT

An electrical connector assembly for connecting a first contact to a second contact is disclosed including a receptacle member and a plug member. The receptacle member has a recess at one end defined by a resilient wall having an outer end terminating in an inwardly projecting lip and includes means for supporting the first contact in a manner such that the contact extends into the recess. The plug member has a projection at one end defined by a neck portion having an inner end terminating in a contact-receiving face and includes means for supporting the second contact in a manner such that the contact extends within the projection. The plug member also has a collar positioned along the neck portion so that the first contact mates with the second contact prior to engagement of the lip with the collar. With these features of construction, the neck portion is formed no larger in transverse dimension than the lip whereby the neck portion can be inserted into the recess free of interference until after the critical mating function has occurred.

3 Claims, 9 Drawing Figures

ENVIRONMENTAL CONNECTOR ASSEMBLY

This application is a continuation of application Ser. No. 236,369, filed 2/20/81, now abandoned, which is a continuation of application Ser. No. 864,975 filed 12/07/77, now abandoned.

BACKGROUND OF THE INVENTION

The present invention relates to an electrical connector assembly and, more particularly, to an environmentally sealed electrical connector assembly having components configured to reduce the force required to effect the electrical connection.

Electrical connector assemblies capable of protecting their internal components from harmful environmental factors are now used extensively in the transportation and communication industries. These connectors are particularly useful, and in fact necessary, in many applications where it is necessary to prevent moisture from reaching the mating contacts of the connector. While there are many different electrical connector assemblies of this type, typical examples of such connectors are those disclosed in commonly owned U.S. Pat. Nos. 3,930,705 and 3,953,099.

Misalignment of contacts in electrical connectors rendering assembly difficult and time-consuming and accounting for faulty electrical connections as well as damaged contacts has been substantially overcome by the structures disclosed and claimed in the reference patents. The earlier of the patents accomplished this with a cam surface on the receptacle member and a cam follower on the plug member whereas the later of the patents accomplished this with a molded shape inside the receptacle member and a matching cut-away portion on the plug member. These patents therefore disclose two very effective means for preventing mating otherwise than in properly polarized relation. The primary mating seal in both of the patents occurs as a result of an interference fit between a lip of the receptacle member and the plug member surface. While these electrical connector assemblies have met with considerable commercial success, there are certain disadvantages associated with their use which have limited their utility and acceptance.

For example, the patents contemplate the receptacle member and the plug member being individually formed of resilient insulating material customarily having a high coefficient of friction. This makes it possible for the primary mating seal to be accomplished by the mating halves with an interference fit. It also provides a mating lock in that a lip of the receptacle member must override diametrical interference of the plug member in order to disengage the plug member and the receptacle member. This compounds the mating problem, however, due to the considerable force required to overcome the interference fit so as to provide straight push-pull mating without skewing or bending the mating halves. The resilient material and the interference fit also tends to mask the "feel" of alignment of the contacts during the mating cycle increasing the possibility that the contacts will be bent or damaged.

As a result, an electrical connector assembly characterized by reduced mating forces has been sought wherein the assembly may also utilize other design features including the advantages inherent in the referenced patents.

SUMMARY OF THE INVENTION

Accordingly, the present invention is directed to an environmentally sealed electrical connector assembly having a receptacle member and a plug member requiring relatively low mating forces. The receptacle member has a recess at one end defined by a resilient wall having an outer end terminating in an inwardly projecting lip and includes means for supporting the first contact so that the contact extends into the recess. The plug member has a projection at one end defined by a neck portion having an inner end terminating in a contact-receiving face and includes means for supporting the second contact so that the contact extends within the projection. The plug member also has a collar axially located on the neck portion to cooperate with the lip in providing an environmental seal with the neck having a maximum transverse dimension no larger than the inner diameter of the lip but with the collar being larger in transverse dimension than the lip. With these features of construction, the collar is positioned along the neck portion such that the first contact mates with the second contact prior to engagement of the lip with the collar.

In a preferred embodiment, the receptacle member has a longitudinal axis with the contact supporting means cooperating to hold the first contact parallel to that axis. The resilient wall defining the recess in the receptacle member is suitably annular with the lip projecting inwardly in a circumferential manner at the outer end of the wall and the neck defining the projection suitably includes an inner end terminating in a shoulder with the shoulder and the collar defining a lip-receiving groove. The plug member likewise has a longitudinal axis with the contact supporting means cooperating to hold the second contact parallel to that axis.

The electrical connector can be assembled by inserting the neck portion into the recess free of interference until the first contact has mated with the second contact. The neck portion can then be further inserted into the recess free of interference until the lip engages the collar. Finally, the neck portion can be fully inserted into the recess by overcoming interferences of the lip with the collar to cause the lip to pass over the collar into the lip-receiving groove.

Other preferred features include providing additional corresponding contacts in the receptacle member and the plug member so as to define a first set of contacts and a second set of contacts, respectively. The first contact support means can in any event, be a corresponding number of first passageways in the receptacle member extending parallel to the receptacle member axis and the second contact support means can be a corresponding number of second passageways in the plug member extending parallel to the plug member axis. With these features of construction, the first passageways support the first set of contacts parallel to the receptacle member axis and the second passageways support the second set of contacts parallel to the plug member axis.

Preferably, a first contact extends from a first passageway into the recess to a point spaced inwardly from the lip. The wall defining the recess and the neck portion defining the projection have longitudinal axes coinciding with the receptacle member axis and the plug member axis, respectively, and the neck portion being generally cylindrical and having an outer end terminating in an extension having a contact-receiving face. A second contact extends along a second passageway within the projection to a point spaced inwardly from the contact-receiving face.

In another preferred embodiment, the electrical connector assembly includes cam means on the receptacle member and cam follower means on the plug member for engagement with the cam means on the receptacle member. The cam means and cam follower means are operative in response to insertion of the projection into the recess and axial pressure between the receptacle member and the plug member to rotate the projection relative to the recess to a predetermined angular position. By reason of the cooperation between the cam means and the cam follower means, it is possible to automatically angularly align a first contact with a second contact.

The present invention is therefore directed to an improved electrical connector assembly in which the receptacle member and the plug member are designed such that high mating forces are reduced with interference occurring only where absolutely necessary to provide sealing and locking. It is further directed to structure permitting polarization of the mating halves and pick up of the contacts prior to encountering the sealing and locking interferences. The present invention makes it possible to achieve the critical mating functions in a manner in which they are not affected by the high force required to complete the mating cycle. It also makes it possible to achieve complete assembly with a significantly reduced possibility of bending or damaging the contacts as a result of the limited sealing and locking interferences. Other objects and advantages of the present invention will be appreciated from a consideration of the details of construction and operation set forth in the accompanying specification, claims and drawings.

BRIEF DESCRIPTION OF THE DRAWINGS

The present invention is described in conjunction with the accompanying drawings, in which—

Figure 5:
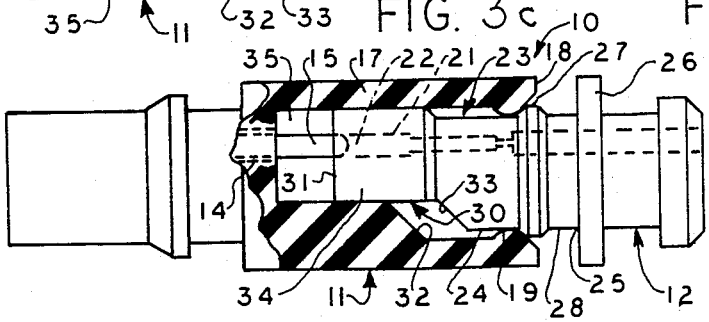

FIGS. *3a*, *3b* and *3c* are a series of side elevational views, partially in section, illustrating the manner in which the plug member and the receptacle member cooperate so as to be guided into proper alignment;

FIGS. *4a*, *4b* and *4c* are a series of largely diagrammatic end views corresponding to FIGS. *3a*, *3b* and *3c*, respectively, illustrating the manner in which the plug member and the receptacle member cooperate so as to be guided into proper alignment; and FIG. 5 is a side elevational view, partially in section, illustrating engagement of the lip of the plug member with the collar of the receptacle member.

DETAILED DESCRIPTION OF THE PREFERRED EMBODIMENT

Figure 1:
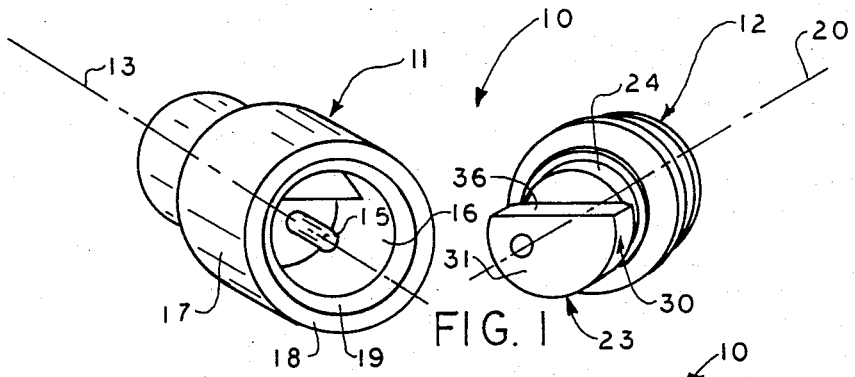
FIG. 1 is a perspective view of a plug member and a receptacle member of an electrical connector assembly embodying the concepts of the present invention.

In the illustration given and with reference first to FIG. 1, the present invention is directed to an electrical connector assembly 10 which includes a receptacle member 11 and a plug member 12. The receptacle member 11 has a longitudinal axis 13 with means 14 (as shown in FIG. 5) for supporting a first contact 15 parallel to the axis 13. It also includes a recess 16 at one end defined by a resilient annular wall 17 having an outer end 18 terminating in an inwardly projecting circumferential lip 19. The first contact 15 extends from the contact supporting means 14 into the recess 16.

The plug member 12 has a longitudinal axis 20 with means 21 for supporting a second contact 22 parallel to the axis 20. It also includes a projection 23 at one end defined by a neck portion 24 having an inner end 25 terminating in a shoulder 26. The second contact 22 extends within the contact supporting means 21 in the projection 23.

Figure 2:
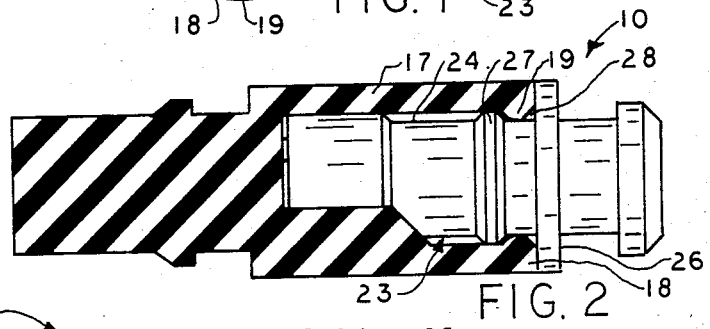
FIG. 2 is a side elevational view, partially in section, illustrating the electrical connector assembly of FIG. 1 in fully assembled relation.

Referring to FIG. 2, the neck portion 24 has an annular collar 27 axially spaced from the shoulder 26 to define a lip-receiving groove 28. The neck portion 24 has a transverse dimension no larger than the inner diameter of the lip 19 with the collar 27 having a diameter slightly larger than the inner diameter of the lip 19. The collar 27 is axially positioned along the neck portion 24 so that the first contact 15 mates with the second contact 22 prior to engagement of the lip 19 with the collar 27.

With these features of construction, the electrical connector 10 can be assembled by inserting the neck portion 24 into the recess 16 free of interference until the first contact 15 has mated with the second contact 22. The neck portion 24 can then be further inserted into the recess 16 free of interference until the lip 19 engages the collar 27. Completing the assembly of the electrical connector 10, the neck portion 24 can be fully inserted into the recess 16 by overcoming interference of the lip 19 with the collar 27 to cause the lip 19 to pass over the collar 27 into the lip-receiving groove 28.

Referring to FIG. 5, the first contact support means 14 is preferably a first passageway in the receptacle member 11 extending parallel to the receptacle member axis 13 and the second contact support means 21 is preferably a second passageway in the plug member 12 extending parallel to the plug member axis 20. An outer end or extension 30 may be provided as a portion of the projection 23 integral with the neck portion 24 but, in any event, the projection 23 will terminate in a contact-receiving face 31. The first contact 15 will extend from the first passageway 14 into the recess 16 to a point spaced inwardly from the lip 19 and the second contact 22 will extend along the second passageway 21 within the projection 23 to a point spaced inwardly from the contact-receiving face 31.

As shown in FIG. 2, the shoulder 26 of the receptacle member 12 has a diameter larger than the inner diameter of the lip 19. The relative sizing of the shoulder 26 and the lip 19 make it clear that the shoulder 26 acts as a stop relative to the lip 19 during assembly of the electrical connector 10. Of course, the receptacle member 11 and the plug member 12 are each suitably integrally formed in one piece of a resilient insulation material in accordance with commonly known fabrication techniques.

Referring again to FIG. 1, it will be clear that the annular wall 17 has a longitudinal axis coinciding with the plug member axis 20. Likewise, the neck portion 24 of the projection 23, which is generally cylindrical in the preferred embodiment, has a longitudinal axis coinciding with the receptacle member axis 13. Moreover, the plug member axis 13 and the receptacle member axis 20 will coincide, as well, upon completing assembly of the electrical connector 10.

With the features described in detail, the electrical connector assembly 10 may also incorporate other features of prior art electrical connector assemblies. It may, for instance, suitably utilize cam means 32 on the receptacle member 11 and cam follower means 33 on the plug member 12 for engagement with the cam means 32 on the receptacle member 11 as more fully disclosed in commonly owned U.S. Pat. No. 3,930,705. The significant advancement in the art and the disclosure of that advancement in the referenced patent are incorporated herein by reference although a more detailed description of the cam means 32 and the cam follower means 33 will follow. It may, of course, utilize still other inventive features in the art such as the alignment means disclosed in commonly owned U.S. Pat. No. 3,953,099. In fact, the inventive concepts embodied in the electrical connector assembly 10 of the present invention may incorporate a wide variety of features of prior art assemblies.

Figure 3A:
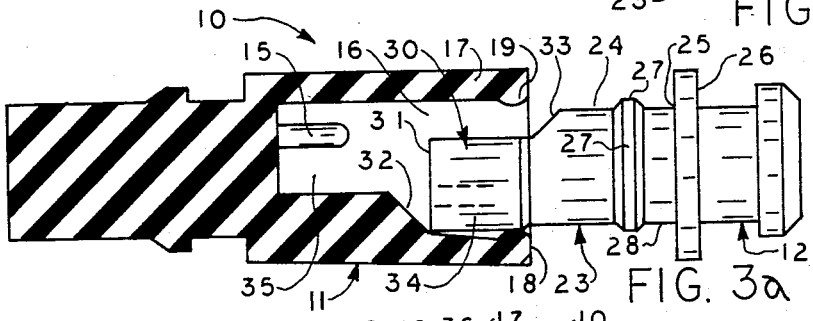
Figure 4A:
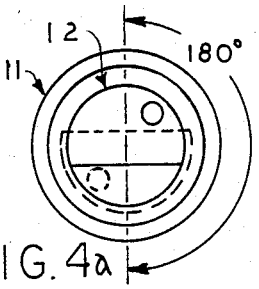

As will be seen from FIGS. 3*a*–3*c* and 4*a*–4*c*, the projection 23 on the plug member 12 may be inserted into the recess 16 of the receptacle member 11 at a variety of different angles. As an example, the members can be 180° out of alignment with the first contact 15 disposed above the horizontal mid-plane bisecting the members and the second contact 22 below the plane as shown in FIGS. 3*a* and 4*a*. The juncture or corner of the contact-receiving face 31 and the peripheral axially extending circumferential surface portion 34 of the extension 30 will then engage the cam means 32. As axial pressure is applied between the receptacle member 11 and the plug member 12, the plug member 12 will rise along the cam means 32 in order to move forward into the recess 16. Since the projection 23 is prevented from fully entering the recess 16 in the position shown in FIGS. 3*a*–3*b* and 4*a*–4*b*, the plug member 12 must rotate relative to the receptacle member 11 into the position shown in FIGS. 3*c* and 4*c* to permit the projection 23 to both rise and move forward into the recess 16.

Figure 3B:
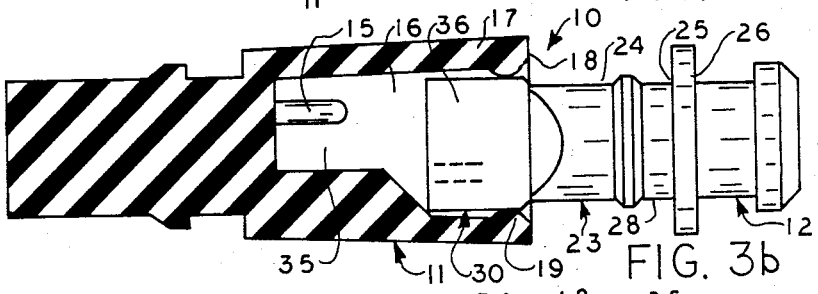
Figure 4B:
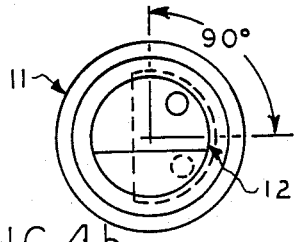
Figure 3C:
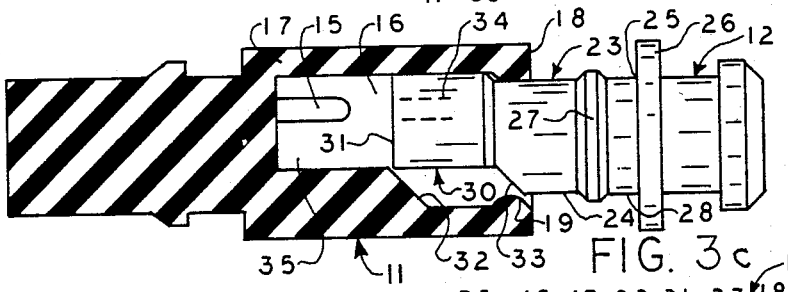
Figure 4C:
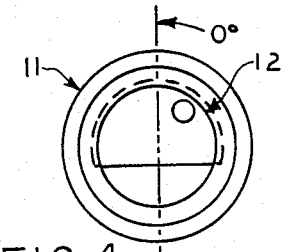

When utilizing the cam means 32 and the cam follower means 33, the electrical connector 10 can be assembled by inserting the projection 23 into the recess 16 in any angular position. It will sometimes happen that the first contact 15 is perfectly aligned with the second contact 22 as shown in FIGS. 3*c* and 4*c*. Usually, the respective contacts 15 and 22 will be out of alignment, for example, as shown in FIGS. 3*a*–3*b* and 4*a*–4*b* in which case the juncture between the contact-receiving face 31 and the annular surface 34 of the extension 30 will engage the cam means 32 as already discussed. It will then require increased axial pressure between the receptacle member 11 and the plug member 12 to cause the projection 23 to rotate relative to the recess 16 to the correct angular position. When this has been done, however, the first contact 15 will be angularly aligned with the second contact 22.

While the camming action is taking place, the neck position 24 will be free of interference with the lip 19. The respective contacts 15 and 22 can therefore be angularly aligned without any tendency to mask the feel of alignment as the cam follower means 33 is moved toward engagement with the cam means 32. It will also be appreciated from a consideration of FIG. 5 that the respective contacts 15 and 22 will actually mate prior to engagement of the lip 19 with the collar 27. The respective contacts 15 and 22 are therefore far less likely to be bent or damaged inasmuch as alignment and mating are completed prior to application of the considerable axial force required to overcome the interference of the lip 19 with the collar 27. Since the contacts 15 and 22 are aligned and mated and the cam follower means 33 and the cam means 32 are properly oriented, the electrical connector 10 can be fully assembled by applying the necessary force under control without skewing or bending the receptacle member 11 and the plug member 12 to cause the lip 19 to pass over the collar 27 and into the lip-receiving groove 28.

With the lip 19 in the lip-receiving groove 28, a primary mating seal is provided which also acts as a mating lock because the lip 19 must once again pass over the collar 27 and out of the lip-receiving groove 28 in order to disengage the receptacle member 11 and the plug member 12, Accidental disengagement of the receptacle member 11 and the plug member 12 is practically precluded and the snug interference fit between the lip 19 and the lip-receiving groove 28 as well as between the collar 27 and the inner surface of the wall 17 provides an excellent primary environmental seal. When it is desired to disassemble the electrical connector, the considerable axial force required to accomplish this is again easy to control without skewing or bending the receptacle member 11 and the plug member 12 since the force applied need only be sufficient to cause the lip 19 to pass out of the lip-receiving groove 28 and over the collar 27.

As best seen in FIGS. 3*a* to 3*c* and 5, the lip 19 is disposed at the longitudinally forward portion of the receptacle and terminates in the outer end 18 to define a forward extremity of the receptacle member 11. The forward extremity acts as a stop for seating the shoulder 26 into abutment against the lip.

Viewing the invention in a more basic form, the electrical connector assembly 10 is of a type including a resilient receptacle member 11 and a resilient plug member 12. The receptacle member 11 has a recess 16 defined by a wall 17 with an outer end 18 of the wall 17 terminating in an inwardly projecting lip 19 and it has means 14 for supporting a first contact 15 in the recess 16. The plug member 12 has a projection 23 for insertion into the recess 16 and it also has means 21 for supporting a second contact 22 in the projection 23. The plug member 12 also includes the projection 23 having a collar 27 positioned such that it cooperates with the lip 19 to provide an environmental seal with the projection 23 being no larger in transverse dimension than the lip 19 but with the collar 27 being slightly larger in transverse dimension than the lip 19. With these basic features of construction, the collar 27 is positioned such that the first contact 15 mates with the second contact 22 prior to engagement of the lip 19 with the collar 27.

In prior art constructions, the lip interferred with the projection substantially along its entire length since the projection usually had an outer diameter slightly greater than the inner diameter of the lip. This problem was aggravated by the high coefficient of friction between the lip and the projection resulting from the use of resilient insulating materials. The problem has now been overcome reducing the high mating forces previously required by modifying the projection so that interference occurs only where necessary to provide the necessary sealing and locking features. The transverse dimension of the projection has been reduced along a portion of its length to define a neck portion providing little or no interference with the lip during most of the initial mating penetration prior to sealing and locking. In the mating cycle, this permits polarization or angular alignment of the mating halves and pick up of the contacts prior to engagement of the lip with the collar to provide the sealing and locking features. The critical mating functions have already occurred at this point thereby eliminating any chance that such functions might be affected by the high force required to complete sealing and locking. With the receptacle member and the plug member substantially telescoped prior to the need for high axial force, the overall length of the connector pair is also considerably shorter reducing the possibility of bending.

Referring again to the drawings, the extension 30 of the projection 23 can suitably be D-shaped in transverse cross-section to mate with a correspondingly shaped portion 35 of the recess 16 and it may have a transverse dimension along the flat or planar surface 36 thereof slightly larger than that of the neck portion 24 of the lip 19. This will require some initial increase in axial force to insert the extension 30 into the recess 16 with a corresponding deformation of the annular wall 17 (as shown in FIG. 3*b* most clearly). The initially increased axial force will not interfere with mating, however, since mating of the contacts 15 and 22 will occur subsequent to full insertion of the extension 30 into the recess 15 at which point the contacts 15 and 22 can be angularly aligned and mated by further inserting the neck portion 24 of the projection 23 into the recess 16 free of interference. This will require a minimum of axial force as the neck portion 24 is further inserted into the recess 16 until the lip 19 engages the collar 27. By this point, the contact 15 will be nearly fully mated with the contact 22 so that the neck portion 24 can be fully inserted into the recess 16 by overcoming the interference of the lip 19 with the collar 27 to cause the lip 19 to pass over the collar 27 into the lip-receiving groove 28.

While in the foregoing specification a detailed description of the invention has been set forth for purposes of illustration, the details herein given may be varied by those skilled in the art without departing from the spirit and scope of the invention as set forth in the appended claims.

We claim:

1. A connector assembly for coupling a first elongate termination element for a signal communication conductor to a second elongate termination element for a signal communication conductor comprising:

an elongate receptacle member having a longitudinal axis and a forward end portion having a forward extremity which is open for receiving a mating plug member and a rearward end portion rearward of said forward end portion for receiving a signal communication conductor, said receptacle member including a cylindrical recess within said forward end portion defined by a continuous resilient annular wall element having an internal diameter adjacent the forward extremity of said forward end portion of a first dimensional value, said wall element terminating at the plug receiving extremity of said forward end portion in a continuous circumferential lip integral at its base with the inner surface of said wall element and radially extending in a direction toward the axis of said receptacle to define a circular recess access opening having a diameter of a second dimensional value less than said first dimensional value, said lip being contoured to provide a sealing surface thereon defined around the innermost extremity of said lip relative to said axis, said receptacle including means within said rearward end portion for supporting said first elongate termination element with the axis thereof parallel to said receptacle member axis, an elongate plug member having a longitudinal axis and a first end portion having a mating face at its forward extremity for mating with said receptacle member and a second end portion disposed rearwardly of said first end portion for receiving a signal communication conductor with means within said plug member for supporting said second elongate termination element with its axis parallel to the axis of said plug member, the first end portion of said plug being comprised of four cylindrical longitudinally contiguous sections, the first and forwardmost of said sections having a diameter no greater than said second dimensional value to define a neck portion, the second of said sections having a maximum diameter larger than said second dimensional vaue to define a collar portion, the third of said sections having a maximum diameter not less than said second dimensional value to define a sealing surface portion, and the fourth of said sections having a maximum diameter greater than said first dimension to define a shoulder portion for abutting against the forward extremity and limiting longitudinal entry of the plug into the recess to determine fully mated condition of said receptacle and plug members, the relative and aggregate longitudinal lengths of said first, second and third sections combined being such that when said plug is fully mated within said receptacle said lip sealing surface effects a seal against said plug sealing surface portion, and the outer periphery of said collar portion effects a seal against the inner surface of said annular wall element, the inner surface of said annular wall element being relatively smooth and of substantially uniform diameter over a longitudinal distance extending rearwardly from the rear extremity of said lip to a position sufficiently beyond the forwardmost extremity of said collar when said receptacle and plug members are in fully mated condition to allow said shoulder portion to act as a stop against which the forward extremity abuts when said receptacle and plug member are in said fully mated condition, in which said condition, the uniform diameter annular wall element surrounds said neck portion for a longitudinal distance at least as great as the maximum longitudinal extent of said collar.

2. A connector according to claim 1 wherein said collar portion defined by said plug section has an outside diameter slightly greater than said first dimensional value with a continuous flatened surface portion on its outer periphery so as to enhance the sealing of said collar portion within the inner surface of said annular wall element when said plug is fully mated within said receptacle.

3. A connector according to claim 1 wherein cam means are provided within said receptacle member and cam follower means are provided on said plug member for engagement with said cam means and responsive to the insertion of said plug member and to said recess and axial pressure between said cam means and said cam follower means to rotate said plug relative to said receptacle to a predetermined angular position to angularly align said first termination element with said second termination element prior to said lip engaging said collar.

* * * * *